US008123026B2

(12) United States Patent
DePuydt et al.

(10) Patent No.: US 8,123,026 B2
(45) Date of Patent: Feb. 28, 2012

(54) COIN INVENTORY STORAGE APPARATUS

(76) Inventors: Derek DePuydt, East Troy, WI (US); Kelly DePuydt, East Troy, WI (US)

( * ) Notice: Subject to any disclaimer, the term of this patent is extended or adjusted under 35 U.S.C. 154(b) by 189 days.

(21) Appl. No.: 12/692,282

(22) Filed: Jan. 22, 2010

(65) Prior Publication Data

US 2010/0116692 A1 May 13, 2010

Related U.S. Application Data

(63) Continuation-in-part of application No. 11/788,170, filed on Apr. 20, 2007, now abandoned.

(51) Int. Cl.
*A45C 1/00* (2006.01)

(52) U.S. Cl. ..... 206/0.81; 206/0.84

(58) Field of Classification Search ..... 206/0.81, 206/0.8, 0.82, 0.83, 0.84, 730, 734, 303, 206/445, 366, 443, 446, 562; D99/34, 36, D99/37; 232/1 D, 4 R; 220/23.4, 23.6
See application file for complete search history.

(56) References Cited

U.S. PATENT DOCUMENTS

| | | | | | |
|---|---|---|---|---|---|
| 205,967 | A * | 7/1878 | Leach | 206/0.84 |
| 339,420 | A | 4/1886 | Hubbard et al. | |
| 781,810 | A * | 2/1905 | Corbett | 206/0.83 |
| 886,345 | A | 5/1908 | Burns | |
| 1,349,786 | A | 8/1920 | Schlueter | |
| 2,026,362 | A | 12/1935 | Salzman | |
| 2,597,365 | A | 5/1952 | Newman | |
| 2,844,248 | A | 7/1958 | Tiberio | |
| 3,429,425 | A | 2/1969 | Hebert | |
| 4,572,423 | A * | 2/1986 | Spencer | 206/562 |
| 6,036,020 | A * | 3/2000 | Distler | 206/564 |
| 6,510,973 | B1 * | 1/2003 | Ichioka | 206/0.83 |
| 6,604,626 | B1 * | 8/2003 | Hanshaw | 206/0.81 |
| 7,708,143 | B2 * | 5/2010 | Adams | 206/549 |

* cited by examiner

*Primary Examiner* — J. Gregory Pickett
*Assistant Examiner* — Andrew Perreault
(74) *Attorney, Agent, or Firm* — Absolute Technology Law Group, LLC

(57) ABSTRACT

The present invention is a coin inventory storage apparatus which allows a coin collector to store and display multiple coins. The coin inventory storage apparatus contains a plurality of selectively removable tubular structures for storing and displaying coins.

17 Claims, 6 Drawing Sheets

COIN INVENTORY STORAGE APPARATUS

CROSS-REFERENCE TO RELATED APPLICATIONS

This application is a continuation-in-part application that claims priority to U.S. Nonprovisional application Ser. No. 11/788,170 filed on Apr. 20,2007 now abandoned.

FIELD OF INVENTION

The present invention relates to the field of storage components for collector items and more particularly to storage component for storing and displaying multiple coins.

GLOSSARY

Figure 1:
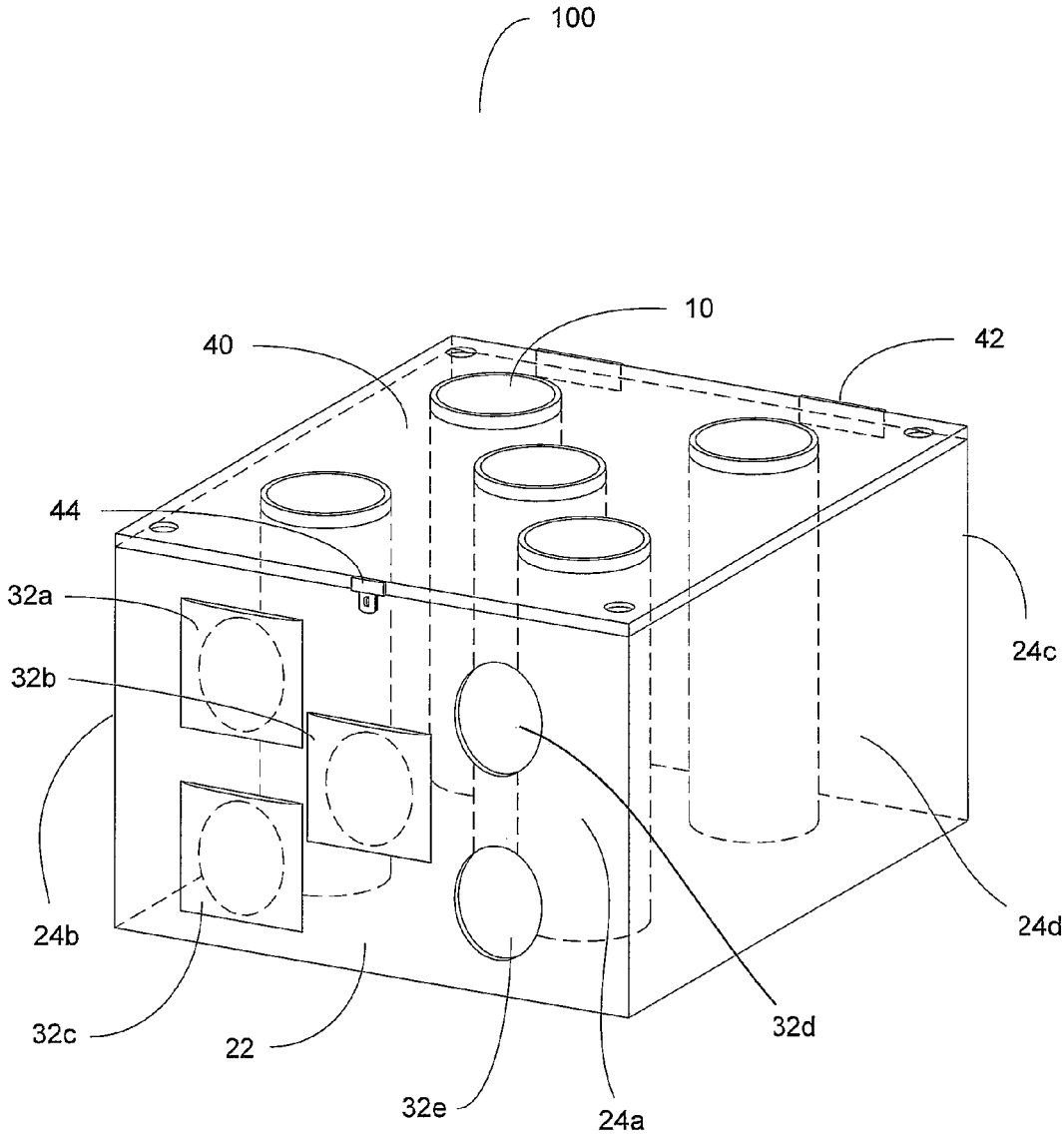
FIG. 1 illustrates a perspective view of an exemplary embodiment of a coin inventory storage apparatus.

As used herein, the term "adjustable" refers to a component that is capable of being changed to match, fit or correspond to a specification of another component (e.g., size, shape).

As used herein, the term "coin receptacle" refers to a container which receives and holds coins.

As used herein, the term "integral display unit" refers to a component used to show, exhibit and/or store coins comprised of individual housing components.

As used herein, the term "interlocking structural component" refers to a feature of a housing component that facilitates connecting to a second housing component. For example, interlocking structural components may include, but are not limited to a contour, sliding track, magnetic component, interlocking ridge, snapping component, bracket, locking component tab, screw, and brace.

As used herein, the term "partially threaded surface" refers to a component having threads on a portion of its outer surface for fastening or securing another component.

As used herein, the term "pressure sensitive apertures" refers to an opening that is protected or concealed by a cover that opens when force is exerted on the cover.

As used herein, the term "selectively removable" refers to a component that is capable of being removed at the discretion of an individual.

As used herein, the term "display apertures" refers to an opening or other receptacle, such as a pocket, which allows a collector to display a message, image, coin or other object.

BACKGROUND

There are many products known in the prior art available for coin collectors to use to display and/or store their coins.

For example, coin albums contain one or more pages designed to hold a designated number of a specific size coin. Coin portfolios or folders are available for storing a particular collection of coins (e.g., Presidential $1 Coins or D.C. and U.S. Annual Set) and contain a single designated space for each coin in the set. Coin albums are undesirable because a single album allows a collector to store coins only of one size. Folders are often undesirable because they allow a collector to include only one of particular coin while the collector may have multiples of a particular coin that he or she would like'to display.

Albums and folders are generally limited to displaying single coins and are not adapted to readily store and track multiple coins. For example, a collector may have several of a certain type of coin in his or her collection and may want them in his or her home or at a coin show. For albums with multiple pages, the collector is able to display only a single coin or spread of pages at a time. In addition, albums and folders, when opened, take up a lot of space for a small number of coins.

Storage boxes designed to hold rolls or tubes of coins or lens sets are also known in the art. These boxes, however, do not allow a collector to display the face of individual coins.

It is desirable to have a coin inventory storage apparatus that allows a collector to be able to both display and store coins.

It is desirable to have a coin inventory storage apparatus that allows a collector to collect multiple coins.

It is desirable to have a coin inventory storage apparatus that allows a collector to display a large number of coins in a small amount of space.

SUMMARY OF THE INVENTION

The present invention is a coin inventory storage apparatus which allows a coin collector to store and display multiple coins. The coin inventory storage apparatus contains a plurality of selectively removable tubular structures for storing and displaying coins.

DETAILED DESCRIPTION OF INVENTION

For the purpose of promoting an understanding of the present invention, references are made in the text to exemplary embodiments of a coin inventory storage apparatus, only some of which are described herein. It should be understood that no limitations on the scope of the invention are intended by describing these exemplary embodiments. One of ordinary skill in the art will readily appreciate that alternate but functionally equivalent materials, sizes and designs may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 shows a perspective view of an exemplary embodiment of coin inventory storage apparatus 100 comprised of bottom surface 22, side support structures 24*a-d* and lid 40. In the embodiment shown, coin inventory storage apparatus 100 further includes five tubular structures 10 for coin storage. In other embodiments, coin inventory storage apparatus 100 may have more or less than live tubular structures.

In the embodiment shown, coin inventory storage apparatus 100 is rectangular and has four side support structures. In other embodiments, coin inventory storage apparatus 100 may have a smaller or greater number of sides and/or may be of another shape, such as square, triangular, circular or oval.

In the embodiment shown, the bottom of tubular structures 10 rests on bottom surface 22 and the top protrudes slightly through apertures in lid 40. In the embodiment shown, tubular structures 10 are designed to accommodate coins that are 24.26 millimeters in diameters (i.e., quarters) and the apertures in lid 40 correspond to the diameter of tubular structures 10 stabilizing tubular structures 10 inside coin inventory storage apparatus 100. In other embodiments, tubular structure 10 may include markings which indicate the number of coins contained in the tubular structure.

Coins are placed into the top of tubular structure 10 and when tubular structure 10 is full, lid 40 may be opened and the tubular structure removed and emptied or replaced with another tubular structure.

In the embodiment shown, bottom surface 22, side support structures 24*a-d*, lid 40, and tubular structures 10 are comprised of plastic and are substantially transparent which allow the collector to see how many coins are in each tubular structure 10 without having to open or remove lid 40. This allows also the collector to efficiently display his coins. In other embodiments, one or more surfaces of coin inventory storage apparatus 100 may be opaque and/or made of another material, such as wood, metal, or recycled materials.

In other embodiments, tubular structures 10 may be designed to accommodate coins having smaller or larger diameters (e.g., pennies, nickels, dimes, half-dollars) or be of varying sizes (e.g., diameters ranging from 17.91 to 40.6 millimeters). For example, coin inventory storage apparatus 100 may contain one tubular structure to hold pennies, one for nickels, one for dimes, one for quarters and one for half-dollars. In one embodiment, the apertures in lid 40 may correspond to tubular structure 10 having a specific diameter (i.e., tubular structure adapted to receive quarters). In other embodiments, the apertures in lid 40 are of uniform size and the upper portion of each tubular structure 10 corresponds to the size of the apertures. In this embodiment, tubular structures 10 may narrow to adapt to the size of the coin to be placed in the tubular structure.

In the embodiment shown, lid 40 further includes optional hinge 42 which connects lid 40 to side support structure 24*c* and optional latch 44 which fastens lid 40 to side support structure 24*a* when closed. In other embodiments lid 40 is not hinged and/or does not include a latch to fasten lid 40 when closed. In other embodiments, lid 40 may rest upon side support structures or be secured by other means, such as contours, sliding tracks, magnetic components, interlocking ridges, snapping components, brackets, locking components, tabs, screws, or braces.

In the embodiment shown, coin inventory storage apparatus further includes display apertures 32*a*-32*e* on side support structure 24*a* which can be used to display a message or coin, such as the coins stored in each tubular structure 10. In the embodiment shown, display apertures 32*a*-32*c* are transparent pockets and display apertures 32*d*-32*e* are openings for inserting coins for display.

In other embodiments, display apertures are located on none or more than one side support structure and/or there are a smaller or larger number of display apertures on a side support structure. In other embodiments, display apertures may be another type of receptacle capable of displaying a coin, image, or message, such as a pressure sensitive aperture, and/or may be all of one type (e.g., all transparent pockets) or may be a combination of types.

Figure 2:
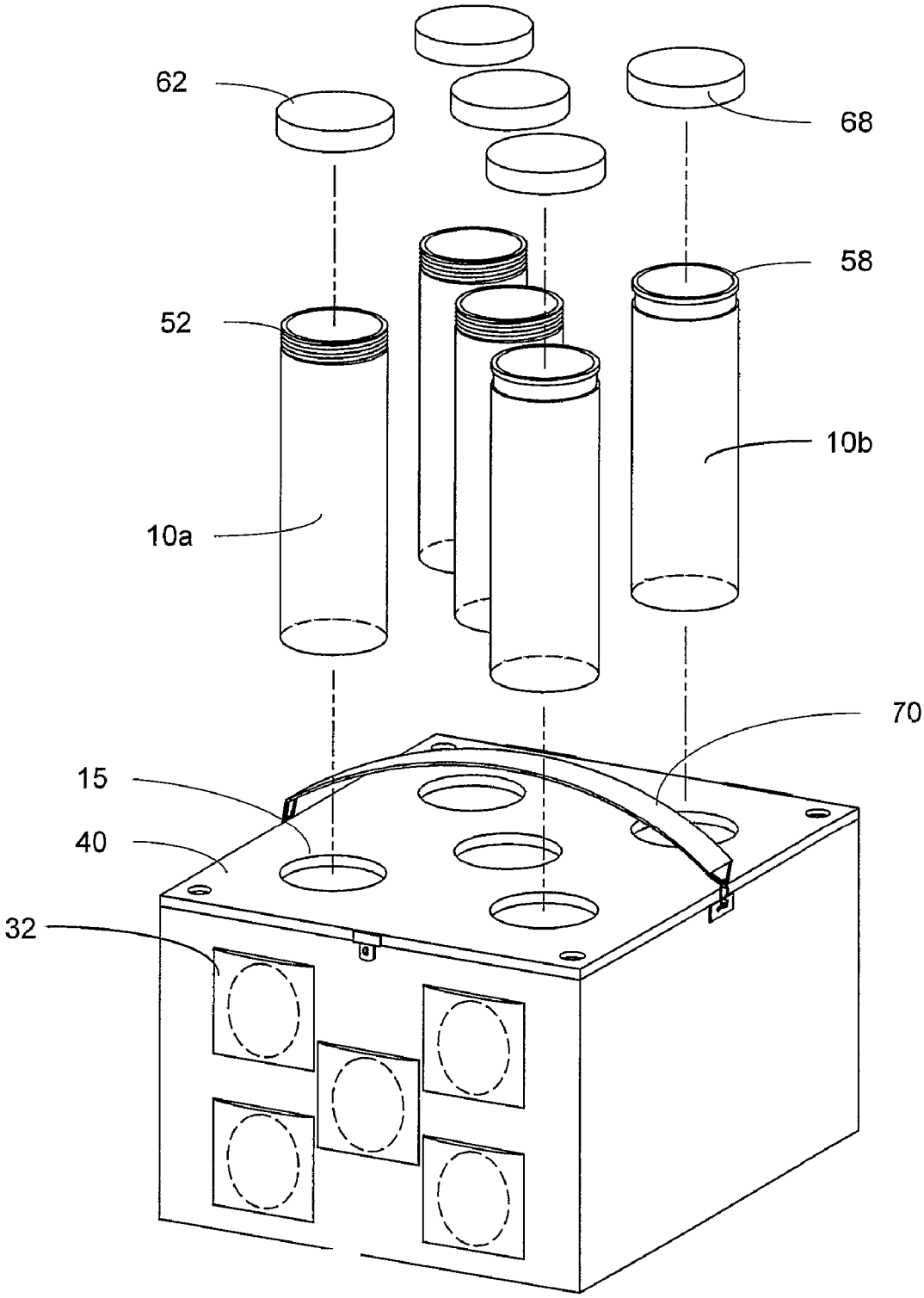
FIG. 2 illustrates an exploded view of an exemplary embodiment of a tubular structure with a threaded neck for use in a coin inventory storage apparatus.

FIG. 2 illustrates an exploded view of exemplary embodiments of tubular structures 10*a*, 10*b* for use in coin inventory storage apparatus 100. In the embodiment shown, tubular structure 10*a* has threaded neck 52 and cap 62 which has threads that correspond to threaded neck 52; and tubular structure 10*b* has a snap-fit neck 58 that cap 68 snaps onto.

Lid 40 has apertures 15 which correspond to the diameter of tubular structures 10. In the embodiment shown, coin inventory storage apparatus 100 further includes optional handle 70 for carrying.

Figure 3:
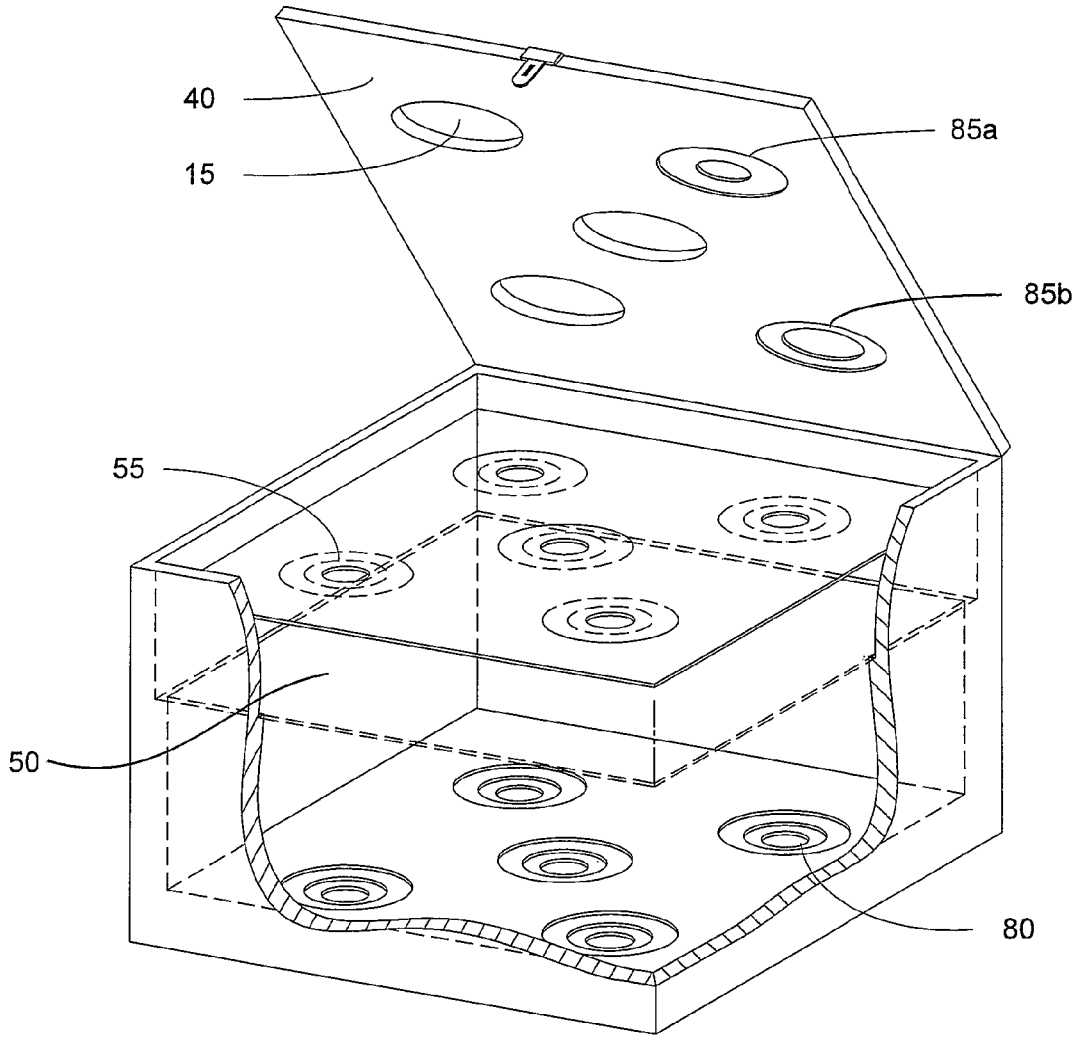
FIG. 3 illustrates a perspective view of an exemplary embodiment of a coin inventory storage apparatus with a center support structure.

FIG. 3 illustrates a perspective view of an exemplary embodiment of coin inventory storage apparatus 100 with optional center support structure 50. In the embodiment shown, center support structure 50 is a made of plastic and has apertures 55 which correspond to the diameter of tubular structures 10 and provide additional support when tubular structures 10 contain a large number of coins. In other embodiments, center support structure 50 may be made of metal, mesh, or any other material capable of supporting tubular structures (not shown) and may be of another shape, (e.g., a grid structure).

In the embodiment shown, bottom surface 22 and lid 40 further include contours 80, 85 to help secure tubular structures 10 to bottom surface 22. In the embodiment shown, contours 80 on bottom surface 22 are adapted to secure tubular structures of various diameters while contours 85*a*, 85*b* on lid 40 are designed for a tubular structure of a specific diameter. For example, contour 85*a* is designed to accommodate a tubular structure adapted to hold dimes and contour 85*b* a tubular structure adapted to hold nickels.

Figure 4:
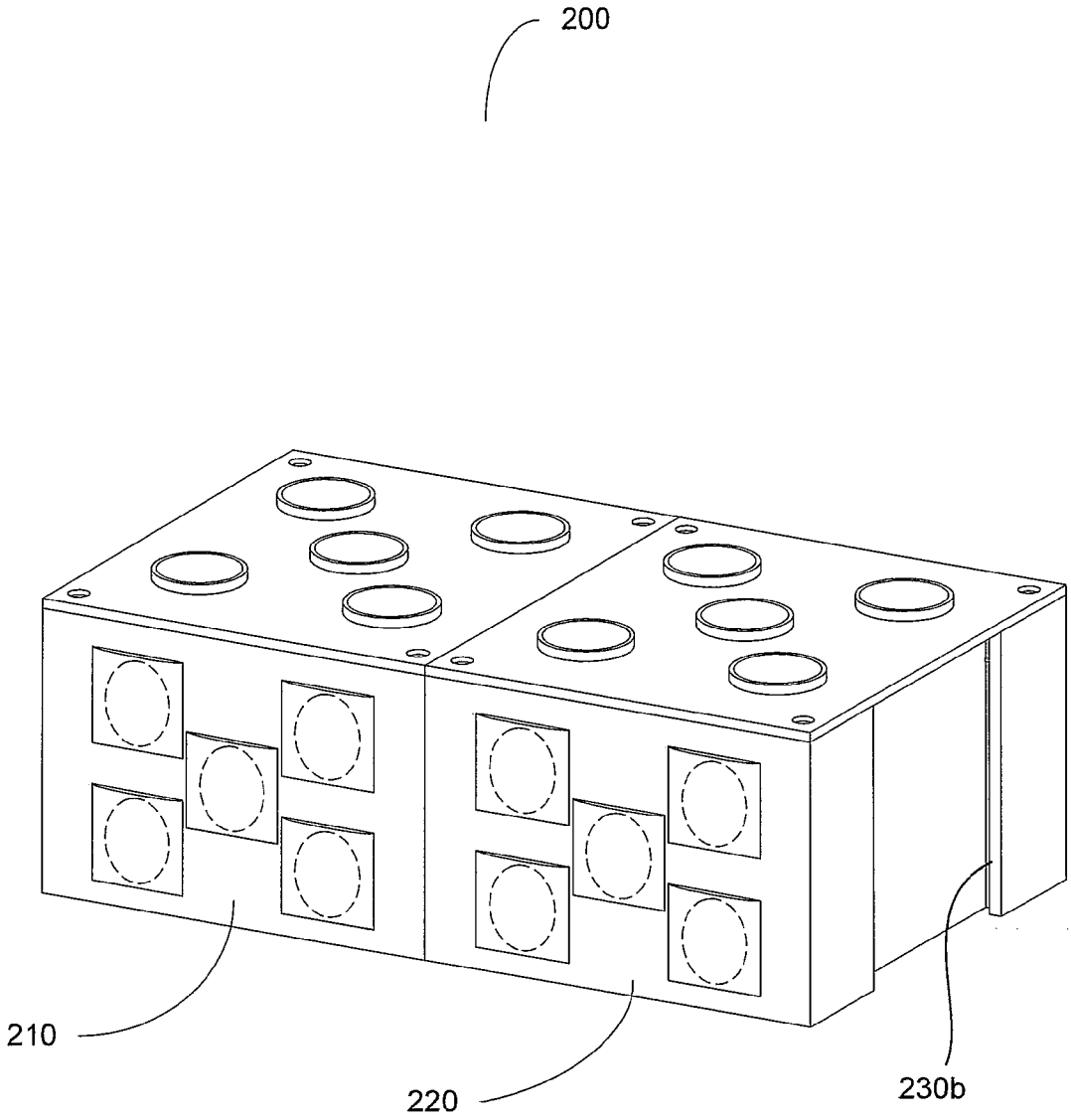
FIG. 4 illustrates a perspective view of an exemplary embodiment of a modular system comprised of a plurality of coin inventory storage apparatuses.

FIG. 4 illustrates a perspective view of an exemplary embodiment of modular system 200. In the embodiment shown, modular system 200 is comprised of coin inventory storage apparatuses 210, 220. Coin inventory storage apparatuses 210, 220 have interlocking structural components 230*a*, 230*b* (230*a* not visible) which interlock, securing coin inventory storage apparatuses together.

In other embodiments, any number of coin inventory storage apparatuses may be interlocked and placed side by side or front to back. In other embodiments, modular system 200 is not comprised of individually assembled coin inventory storage apparatuses but rather is comprised of coin inventory storage apparatuses that are integrally constructed.

Figure 5:
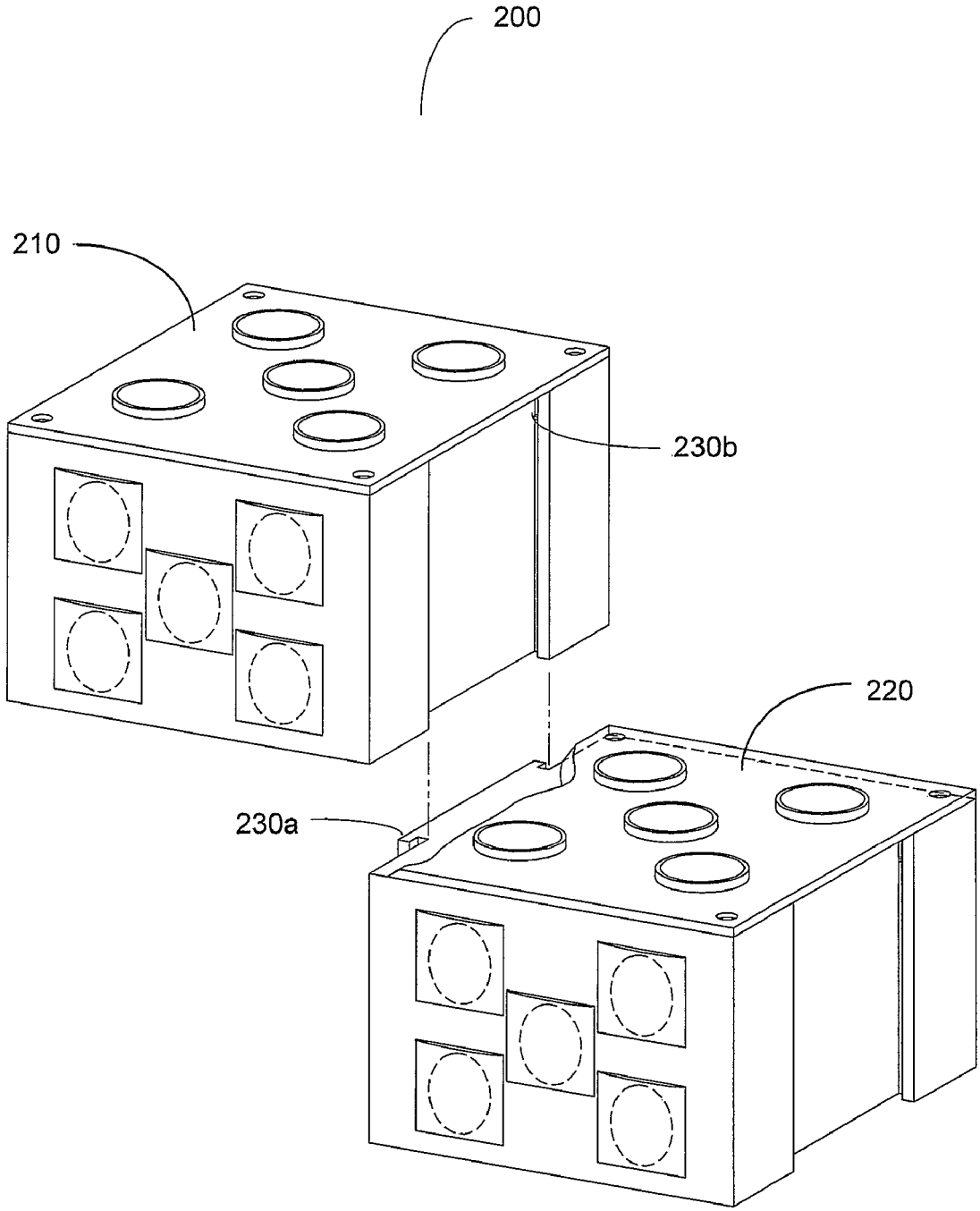
FIG. 5 illustrates an exploded view of an exemplary embodiment of a modular system.

FIG. 5 illustrates an exploded view of an exemplary embodiment of modular system 200 comprised of coin inventory storage apparatus 210, 220. In the embodiment shown, interlocking structural component 230*a* is a groove that corresponds with rail 230*b*. In other embodiments, interlocking structural components may include, but are not limited to a contour, sliding track, magnetic component, interlocking ridge, snapping component, bracket, locking component, tab, screw, and brace.

Figure 6:
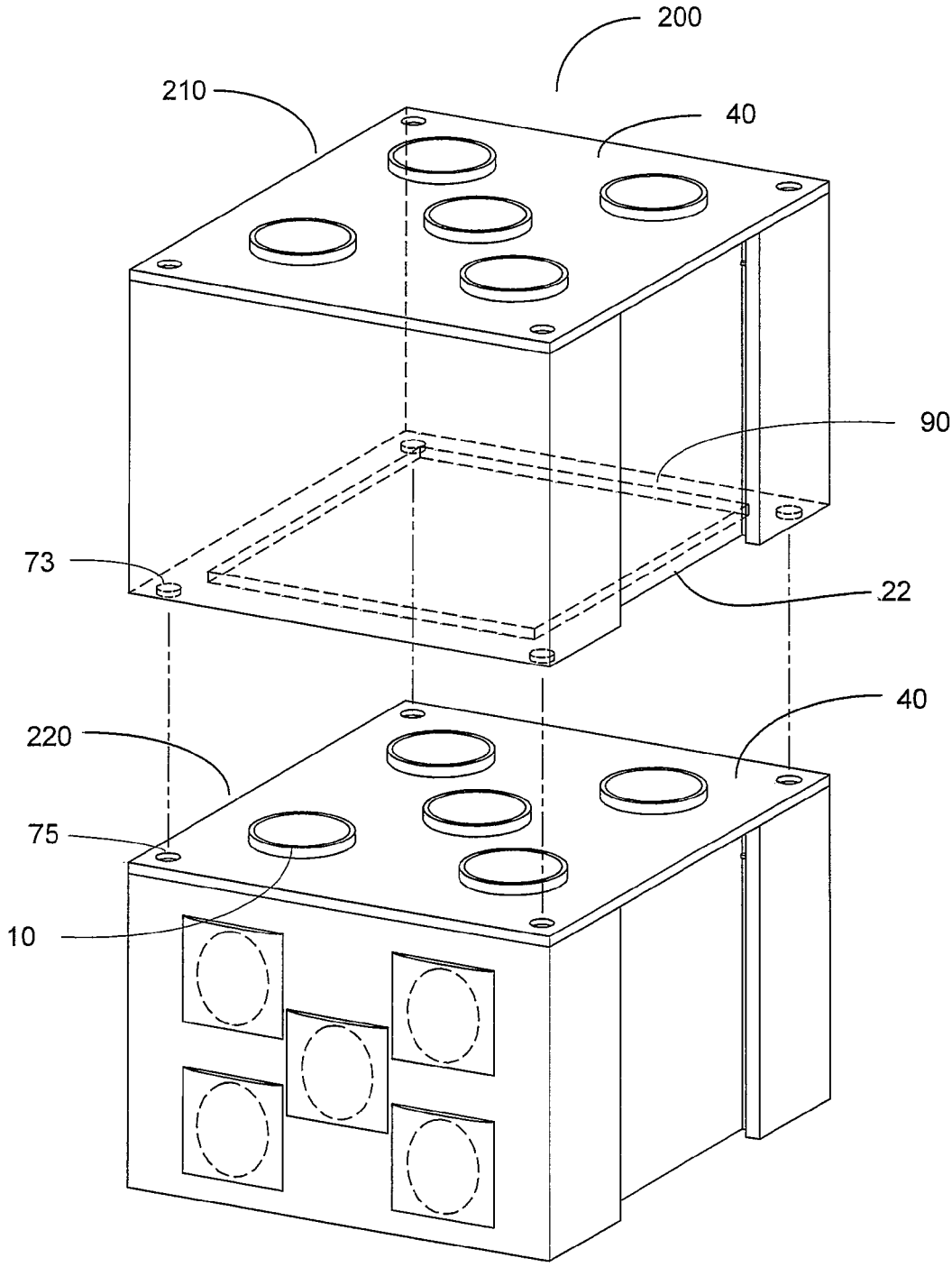
FIG. 6 illustrates an exploded view of an exemplary embodiment of a modular stacking system.

FIG. 6 illustrates an exploded view of an exemplary embodiment of modular stacking system 200 comprised of vertically stacked coin inventory storage apparatuses 210, 220. In the embodiment shown, bottom surface 22 of coin inventory storage apparatuses 210, 220 has raised portion 90 to accommodate tubular. structures 10 which slightly protrude from lid 40.

In the embodiment shown, bottom surface 22 has tab 73 in each corner. Tabs 73 protrude from bottom surface 22 and press into apertures 75 on lid 40 securing coin inventory storage apparatus 210 to the top of coin inventory storage apparatus 220. In other embodiments, other means may be used to vertically stack coin inventory storage apparatuses, such as a contour, sliding track, magnetic component, interlocking ridge, snapping component, bracket, locking component, screw, or brace.

What is claimed is:

1. A coin display apparatus comprised of:

a plurality of selectively removable hollow tubular structures;

an outer housing with a top surface, a base surface, a first side surface, a second side surface, a third side surface, and a fourth side surface, said top surface having a plurality of recessed contours adapted to receive said plurality of selectively removable hollow tubular structures having an upper end and lower end;

wherein said base surface includes recessed contours having a diameter corresponding to an outer diameter of each of said plurality of selectively removable hollow tubular structures and adapted to receive and secure each of said plurality of selectively removable hollow tubular structures;

wherein said lower end of each said plurality of selectively removable hollow tubular structures rests within said recessed contours on said base surface and said upper end of said plurality of selectively removable hollow tubular structures protrude from and are immovably secured by said top surface;

wherein said plurality of selectively hallow tubular structures have an internal diameter of 17.91 millimeters to 40.6 millimeters; and wherein at least one of said side surfaces includes a plurality of coin receptacles which secure at least one coin in position perpendicular to said base surface and substantially parallel to said plurality of selectively removable hollow tubular structures.

2. The coin display apparatus of claim 1 wherein said coin receptacles are pockets adapted to receive coins.

3. The coin display apparatus of claim 2 wherein said pockets have at least one transparent surface.

4. The coin display apparatus of claim 1 wherein said coin receptacles are pressure sensitive apertures into which coins may be pressed.

5. The coin display apparatus of claim 1 wherein said top surface is a hinged lid.

6. The coin display apparatus of claim 1 wherein said outer housing further includes a locking component.

7. The coin display apparatus of claim 1 wherein said hollow tubular structures further include a partially threaded surface.

8. The coin display apparatus of claim 1 which further includes at least one center support structure.

9. The coin display apparatus of claim 1 wherein said outer housing includes at least one substantially transparent surface.

10. The coin display apparatus of claim 1 wherein said hollow tubular structures are substantially transparent.

11. The coin display apparatus of claim 1 wherein said hollow tubular structures include at least one magnetic closure component.

12. The coin display apparatus of claim 1 which further included adjustable components to accommodate hollow tubular structures having variable diameters.

13. The coin display apparatus of claim 12 wherein said adjustable components are selected from the group consisting of sliding components, racks, braces, brackets, tracks, wire, mesh, rubber washers, and flexible ring components.

14. A modular coin display apparatus for displaying coin inventory comprised of:

a plurality of selectively removable hollow tubular structures;

at least one housing component, said housing component having a top surface, a base surface, a first side surface, a second side surface, a third side surface and a fourth side surface, said top surface having a plurality of recessed contours adapted to receive said plurality of selectively removable hollow tubular structures having an upper end and lower end;

wherein said base surface includes recessed contours having a diameter correspondinq to an outer diameter of each of said plurality of selectively removable hollow tubular structures and adapted to receive and secure each of said plurality of selectively removable hollow tubular structures;

wherein said lower end of each said plurality of selectively removable hollow tubular structures rests within said recessed contours on said base surface and said upper end of said plurality of selectively removable hollow tubular structures protrude from and are immovably secured by said top surface;

wherein said plurality of selectively hollow tubular structures have an internal diameter of 17.91 millimeters to 40.6 millimeters;

wherein at least one of said side surfaces includes a plurality of coin receptacles which secure at least one coin in position perpendicular to said base surface and substantially parallel to said plurality of selectivly removable hollow tubular structures; and wherein said at least one housing component is adapted to be selectively attached to at least one additional housing component to form an integral display unit for displaying coin inventory.

15. The modular coin display apparatus of claim 14 wherein the sides of said at least one housing component and said at least one additional housing component include an interlocking structural component.

16. The modular coin display apparatus of claim 14 wherein said at least one additional housing component is stacked on top of said at least one housing component.

17. The modular coin display apparatus of claim 14 wherein said top surface and said base surface of said at least one housing component and said at least one additional housing component include an interlocking structural component for stacking.

* * * * *